US007827838B2

(12) United States Patent
Golovashchenko

(10) Patent No.: US 7,827,838 B2
(45) Date of Patent: Nov. 9, 2010

(54) PULSED ELECTRO-HYDRAULIC CALIBRATION OF STAMPED PANELS

(75) Inventor: Sergey Fedorovich Golovashchenko, Beverly Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 333 days.

(21) Appl. No.: 12/115,028

(22) Filed: May 5, 2008

(65) Prior Publication Data

US 2009/0272167 A1 Nov. 5, 2009

(51) Int. Cl.
*B21D 26/12* (2006.01)
*B21D 26/06* (2006.01)

(52) U.S. Cl. ..... 72/56; 72/63; 72/707; 29/421.1; 29/421.2

(58) Field of Classification Search ..... 72/54, 72/56, 63, 707; 29/421.1, 421.2
See application file for complete search history.

(56) References Cited

U.S. PATENT DOCUMENTS 3,222,902 A * 12/1965 Brejcha et al. ..... 72/56
3,232,086 A 2/1966 Inoue
3,248,917 A 5/1966 Herring, Jr.
3,267,710 A * 8/1966 Inoue ..... 72/56
3,394,569 A * 7/1968 Smith ..... 72/56
3,423,979 A 1/1969 Smith et al.
3,486,062 A 12/1969 Schrom
3,491,564 A 1/1970 Hundley et al.
3,512,384 A 5/1970 Inoue
3,553,434 A 1/1971 Murray
3,559,435 A 2/1971 Gerber
3,566,645 A 3/1971 Lemelson
3,566,647 A 3/1971 Inoue
3,566,648 A 3/1971 Norin et al.
3,575,631 A 4/1971 Pratt
3,591,760 A 7/1971 Inoue
3,593,551 A 7/1971 Roth (Continued)

FOREIGN PATENT DOCUMENTS

GB 1068440 5/1967

(Continued)

OTHER PUBLICATIONS

"Optimization of Initial Blank Shape Predicted Based on Inverse Finite Element Method", Science Direct, Finite Elements in Analysis and Design 43 (2007), pp. 218-233.

(Continued)

*Primary Examiner*—David B Jones
(74) *Attorney, Agent, or Firm*—Raymond L. Coppiellie; Brooks Kushman P.C.

(57) ABSTRACT

A tooling method for calibrating a partially formed metal part in an electro-hydraulic forming tool. The method includes loading a partially formed metal part onto a forming surface of a die. The part is then clamped onto the forming surface and the part is pulsed with a high rate energy pulse to overcome a spring-back effect in the part. The EHF calibration tool includes a punch to which a part is held by clamps while a capacitive discharge circuit is discharged through electrodes provided in the tool. Upon discharge of the capacitive discharge circuit through the electrodes, a high rate energy pulse is applied through a liquid to calibrate the part.

17 Claims, 4 Drawing Sheets

U.S. PATENT DOCUMENTS

| | | | | |
|---|---|---|---|---|
| 3,603,127 | A | 9/1971 | Seiffert et al. | |
| 3,742,746 | A | 7/1973 | Erlandson | |
| 3,814,892 | A | 6/1974 | Inoue | |
| 3,894,925 | A | 7/1975 | Inoue | |
| 4,030,329 | A | 6/1977 | Chachin et al. | |
| 4,942,750 | A | 7/1990 | Conaway | |
| 5,911,844 | A | 6/1999 | Benedyk | |
| 5,948,185 | A | 9/1999 | Krajewski et al. | |
| 6,033,499 | A | 3/2000 | Mitra | |
| 6,215,734 | B1 | 4/2001 | Moeny et al. | |
| 6,227,023 | B1 | 5/2001 | Daehn et al. | |
| 6,349,467 | B1 | 2/2002 | Karafillis et al. | |
| 6,519,851 | B2 | 2/2003 | Bonny et al. | |
| 6,519,992 | B1 | 2/2003 | Schnupp | |
| 6,539,764 | B2 | 4/2003 | Bonny et al. | |
| 6,591,649 | B1 * | 7/2003 | Gafri et al. | 72/56 |
| 6,615,631 | B2 | 9/2003 | Kleber et al. | |
| 6,634,198 | B2 | 10/2003 | Dudziak | |
| 6,881,494 | B2 | 4/2005 | Gehrig et al. | |
| 6,947,809 | B2 | 9/2005 | Ren et al. | |
| 7,117,065 | B1 | 10/2006 | Xia et al. | |
| 7,130,708 | B2 | 10/2006 | Wang et al. | |
| 7,130,714 | B1 | 10/2006 | Kulkarni et al. | |
| 7,150,170 | B2 | 12/2006 | Streubel et al. | |
| 7,165,429 | B2 | 1/2007 | Steingroever | |
| 7,240,532 | B2 | 7/2007 | Zhang et al. | |
| 7,266,982 | B1 | 9/2007 | Guza | |
| 7,493,787 | B2 * | 2/2009 | Golovashchenko et al. | 72/63 |
| 7,516,634 | B1 * | 4/2009 | Golovashchenko et al. | 72/54 |
| 2005/0113722 | A1 | 5/2005 | Schultheiss | |
| 2005/0199032 | A1 | 9/2005 | Krajewski | |
| 2006/0086165 | A1 | 4/2006 | Golovashchenko et al. | |
| 2006/0201229 | A1 | 9/2006 | Zhu et al. | |

FOREIGN PATENT DOCUMENTS

| | | |
|---|---|---|
| GB | 1095276 | 12/1967 |
| GB | 1165902 | 10/1969 |
| GB | 1241343 | 8/1971 |
| GB | 1244922 | 9/1971 |
| GB | 1250901 | 10/1971 |
| GB | 1252997 | 11/1971 |
| GB | 1262072 | 2/1972 |
| GB | 1294240 | 10/1972 |
| RU | 2158644 | 11/2000 |

OTHER PUBLICATIONS

"General Motors' Quick Plastic Formng Process", James G. Schroth, TMS (The Minerals, Metals & Materials Society), 2004, pp. 99-20.

FY 2005 Progress Report, Automotive Lightweighting Materials, pp. 136-140.

"Demonstration of the Preform Anneal Process to Form a One-Piece Alumium Door Inner Panel", Lee et al., SAE Technical Paper Series, No. 2006-01-0987, 2006 SAE World Congress, Detroit, MI, Apr. 3-6, 2006.

"Retrogression Heat Treatments in AA6111" Paul E. Krajewski, General Motors R&D Center, Materials and Processing Laboratory, Oct. 23, 2002.

"Metal Forming with Capacitor Discharge Electro-Spark", E.C. Schrom, Paper SP62-80, published in Advanced High Energy Rate Forming. Book II, ASTME, 1962.

"Research in Electric Discharge Forming Metals", R.L. Kegg et al., Paper SP62-78, published in Advanced High Energy Rate Forming, Book II, ASTME, 1962.

"Formability of Sheet Metal with Pulsed Electromagnetic and Electrohydraulic Technologies", S.F. Golovashchenko, et al., Proceedings of TMS Symposium "Aluminum-2003", San Diego, CA 2003.

"The Effect of Tool/Sheet Interaction in Damage Evolution of Electromagnetic Forming of Aluminum Alloy Sheet", J. Imbert et al, Transactions ASME, Journal of Engineering Materials and Technology, Jan. 2005, vol. 127, pp. 145-153.

"Equipment and Technological Processes with the Employment of Electrohydraulic Effect" G.A. Guliy, et al., Moscow: Mechanical Engineering, 1977.

"Electrohydraulic Effect and Some Potential Applications", L.A. Yutkin, St. Petersburg, 1959.

Concurred: Project Leader of MSTC Project N 1593—Mar. 31, 2003

"Technical Report on Scientific Research Project: Development of the Technology of Static-Electrohydropulsed Drawing on the Punch of Parts of Boxed Shape", Town of Sarov, 2003.

"Heat Treating, Cleaning and Finishing", Metals Handbook, 8th Ed., vol. 2, Amer.Soc.For Metals, pp. 277-278.

"Plants That Have Tough Metals and Large Parts to Form Watch Cautiously As . . . High Velocity Takes Off Again", J. E. Sandford, Iron Age Technical Features, Mar. 4, 1969, vol. 203, pp. 91-95.

* cited by examiner

PULSED ELECTRO-HYDRAULIC CALIBRATION OF STAMPED PANELS

BACKGROUND OF THE INVENTION

1. Field of the Invention

The present invention relates to sheet metal forming processes and tooling for reducing the effect of spring-back on formed panels.

2. Background Art

Sheet metal is generally formed in a sheet metal forming process in which a sheet metal blank is drawn to an initial shape, stamped, flanged, formed and pierced in a series of steps. Spring-back occurs as a result of bending moments that develop in the blank as the sheet metal is formed to the desired shape. Spring-back causes the panels to partially return to a prior shape after a panel is formed in a sheet metal die or other sheet metal forming process.

New types of materials have been proposed for making sheet metal parts with higher strength and lower weight. Specialized steels and aluminum sheets are available that offer high strength and low weight which is desirable in many applications. Many high strength and low weight metals are subject to increased spring-back after forming.

One approach to compensating for spring-back is to predict spring-back in the die design process. The shape of the die may be modified to compensate for spring-back.

Another approach to compensating for spring-back is to stretch the formed blank to eliminate bending moments in the blank. If a part is to be stretched to reduce spring-back, the depth of draw must be limited to permit the stretching operations to adequately compensate for spring-back.

The degree of spring-back may vary from coil to coil. Some coils have only limited spring-back, while other coils even of the same grade or alloy may have greater spring-back. Spring-back is also affected by the extent of wear of the sheet metal forming dies. Increased spring-back may occur when the dies become worn.

The above problems are addressed by Applicant's invention as summarized below.

SUMMARY OF THE INVENTION

According to one aspect of the present invention, a method of calibrating a partially formed metal part is provided. By the term "calibrating" Applicant means that the part is stretched or re-struck to cause the partially formed part to more closely correspond to the desired part configuration. The method includes the step of loading the partially formed metal part onto a forming surface of a die. The part is then clamped onto the forming surface so that exposed portions of the part on opposite sides of the part from the surface engaging the die are exposed. The exposed portions of the part are pulsed with a high-rate energy pulse to overcome a spring-back effect in the part.

According to other aspects of the invention, the loading step may further comprise loading the part into an electro-hydraulic forming tool. In the pulsing step, an electro-hydraulic forming pulse is imparted to the panel.

According to other aspects of the present invention, the clamping step may be performed with a plurality of clamps that engage the part at spaced locations during the time that the high energy rate pulse is applied to the exposed portions of the part. The clamps may be repositioned as a second high energy rate pulse is being applied to the newly exposed portions of the part. Alternatively, the clamping step may be performed with a reticulated clamp having holes or voids through which the high energy rate pulse may be directly communicated to the surface of the part. The voids may be formed by ribs that form a honeycomb or other reticulated structure.

According to yet other aspects of the invention, the partially formed metal part may be formed to a preliminary shape which after spring-back is contoured with a gap being defined between the part and the forming surface of the die. The part may be stretched toward the final part shape to thereby eliminate the gap.

According to another aspect of the present invention, a method of calibrating a partially formed metal part is provided in which the part is clamped by an elastic membrane to a tool that provides a high rate energy pulse. A calibration die having a forming surface may be inserted into the elastic membrane so that the elastic membrane engages an opposite side of the part from the surface engaging the calibration die. A high energy pulse is provided to the elastic membrane and the opposite side of the part through the elastic membrane to relieve stress in the part. The pulse may also stretch the part onto the forming surface of the calibration die to overcome the spring-back effect inherent in the part.

According to other aspects of the invention, the elastic membrane may be provided in conjunction with an electro-hydraulic forming tool that has a chamber that contains a liquid and a plurality of electrodes that are retained within the tool at spaced locations. The electrodes may receive a capacitive discharge that results in a high energy pulse being applied to the elastic membrane and the part to thereby calibrate the part to a desired shape.

According to other aspects of the method, the method may also include forming a metal blank in an electro-hydraulic forming operation before it is processed further as a partially formed part in an electro-hydraulic calibration tool. The elastic membrane may be shaped generally to follow the contour of the opposite side of the part from the surface engaging the die.

The above described aspects of the invention and other features and advantages will be described below with reference to the attached drawings.

DETAILED DESCRIPTION OF THE PREFERRED EMBODIMENT(S)

Figure 1:
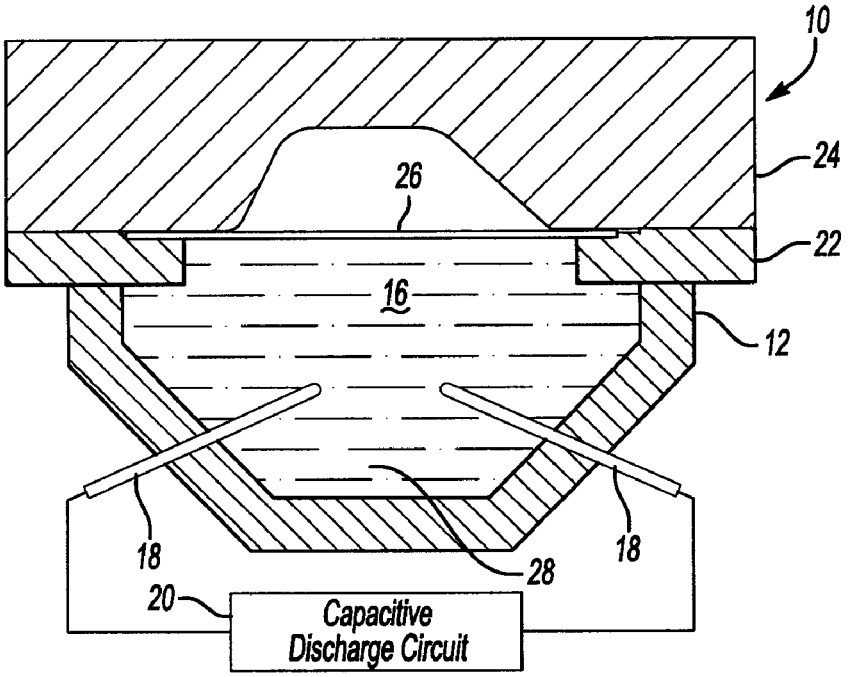
FIG. 1 is a diagrammatic cross-sectional view of an electro-hydraulic forming tool (EHF) shown with a sheet metal blank positioned for forming.

Referring to FIG. 1, an electro-hydraulic forming tool (EHF tool) 10 is shown to include a vessel 12 that defines an EHF chamber 16. A pair of electrodes 18 are connected to a capacitive discharge circuit 20 and extend into the vessel 12. A blank support ring 22 cooperates with an EHF die 24 to support a sheet metal blank 26 in the EHF tool 10. A fluid 28 is supplied to the vessel 12. The vessel 12 is filled with the fluid 28 so that the fluid 28 contacts the sheet metal blank 26.

Figure 2:
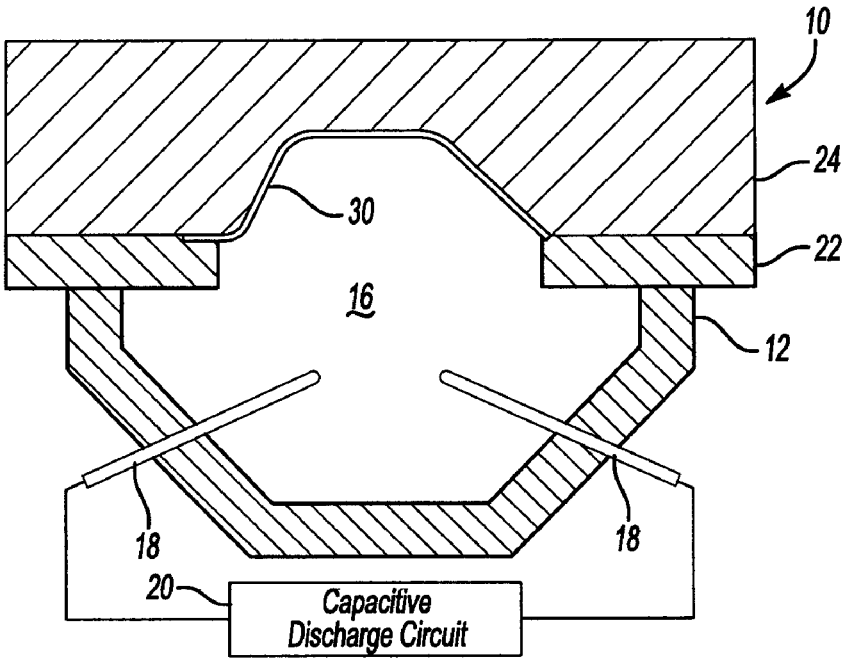
FIG. 2 is a diagrammatic cross-sectional view similar to FIG. 1 after forming the blank into the die cavity of a one-sided EHF die.

Referring to FIG. 2, the EHF tool 10 is shown after the sheet metal blank 26 has been formed into a partially formed part 30. The capacitive discharge circuit 20 has been discharged causing a high rate energy pulse created by the electrodes 18 to form the part 30. The sheet metal blank 26 is held between the blank supporting ring 22 and the EHF die 24. When the tool 10 is open, the part 30 has internal stresses that cause the part 30 to tend to spring-back.

Figure 3:
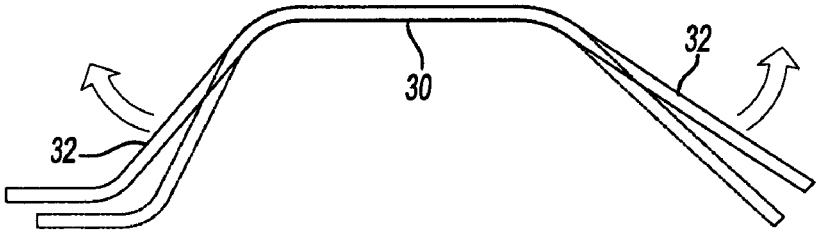
FIG. 3 is a diagrammatic view showing a panel that illustrates spring-back of the panel after forming with a drawing of the part prior to spring-back being provided in phantom lines.

Referring to FIG. 3, a partially formed part 30 is shown with portions subject to spring-back 32 in solid lines. The phantom lines in FIG. 3 illustrate the desired shape of the portion subject to spring-back 32. While the invention is described with reference to the partially formed part 30 being formed in an EHF tool, the part may also be initially formed in a conventional sheet metal forming line or press that includes a die set for forming the sheet metal blank 26 into a partially formed part 30.

Figure 4:
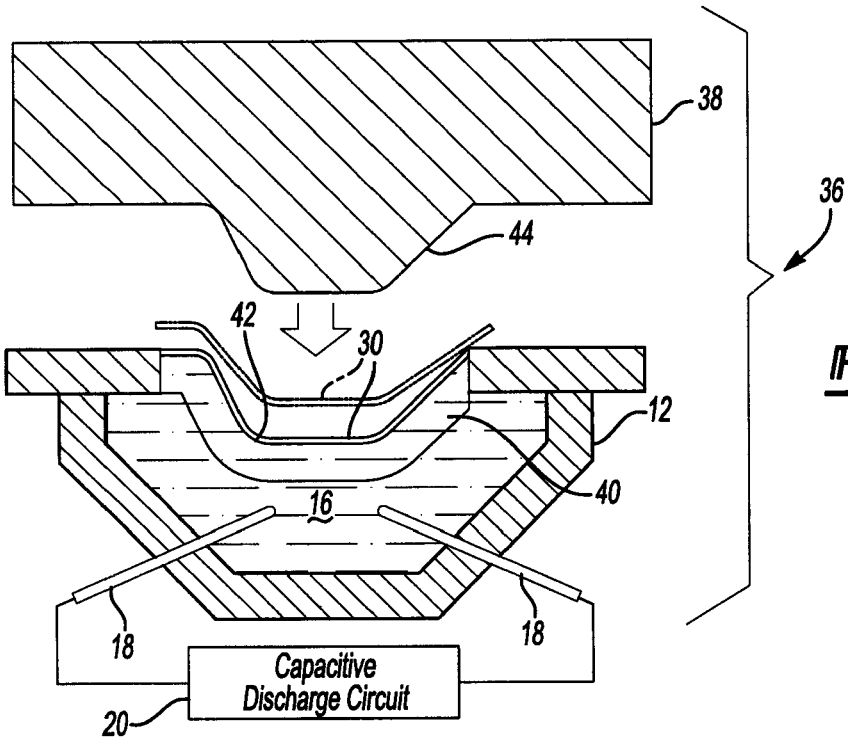
FIG. 4 is a diagrammatic cross-sectional view of a EHF forming tool set up to recalibrate a partially formed part.
Figure 5:
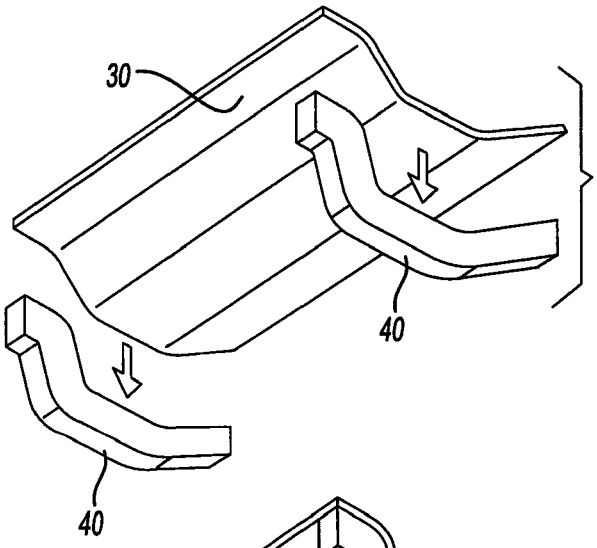
FIG. 5 is a perspective view showing a part and two clamps used to hold the part during recalibration.
Figure 6:
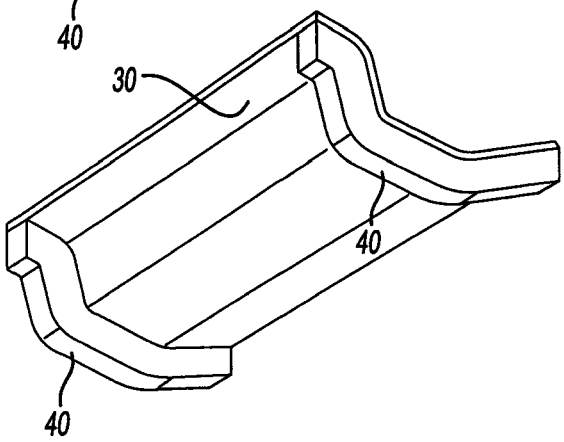
FIG. 6 is a perspective view showing a partially formed part with two clamps secured to one surface of the part.

Referring to FIG. 4, an EHF calibration tool 36 is shown that is similar in many respects to the EHF tool 10 that was described with reference to FIGS. 1 and 2. The EHF calibration tool 36 includes a punch 38. The partially formed part 30 is provided with clamps 40. The clamps are shown in FIGS. 5 and 6 that illustrate assembly of the clamps 40 to the partially formed part 30. Referring back to FIG. 4, a part engaging surface 42 of the clamps 40 engages the partially formed part 30. The clamps 40 hold the part 30 in engagement with a target forming surface 44 of the punch 38. The EHF calibration tool 36 in FIG. 4 is shown open with the punch 38 and target forming surface 44 spaced from the part 30. The clamps 40 engage the part 30 by their part-engaging surface 42. The other parts of the EHF calibration tool 36 are similar to EHF tool 10 and the same reference numerals are used to describe the vessel 12, electrodes 18 and EHF chamber 16.

Figure 7:
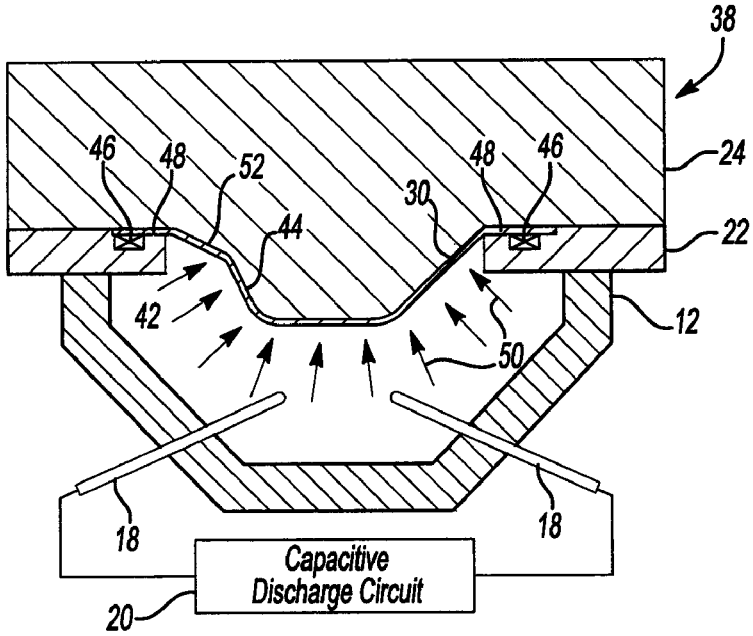
FIG. 7 is a diagrammatic cross-sectional view showing a partially formed part in an EHF calibration tool during a high rate energy pulse.

Referring to FIG. 7, the EHF calibration tool 38 is shown closed with the punch 38 and target-forming surface 44 engaging the partially formed part 30. A seal 46 is provided to seal between the blank supporting ring 22 and a peripheral flange 48 of the partially formed part 30. Arrows 50 are provided to illustrate the high rate energy pulse that is created when the electrodes 18 receive a capacitive discharge from the circuit 20, as previously described with reference to FIGS. 1 and 2. The arrows 50 indicate the pulse or pressure applied through the liquid (not shown in FIG. 7) to the partially formed part 30. A pressure pulse relieves stresses in the partially formed part 30 making the part 30 less prone to spring-back.

If a gap 52 is provided between the part 30 and the target-forming surface 44, the part 30 may be stretched by the pulse.

Figure 8:
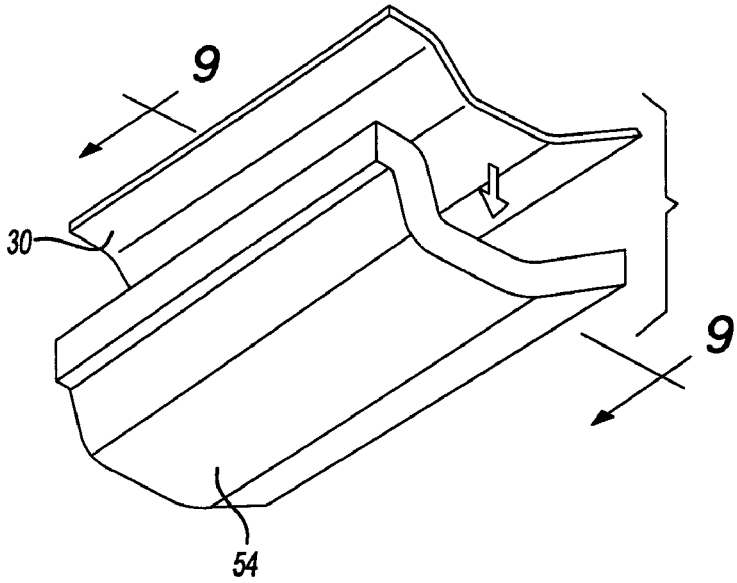
FIG. 8 is a perspective view showing a partially formed panel and an elastic membrane shown in an exploded perspective view.
Figure 9:
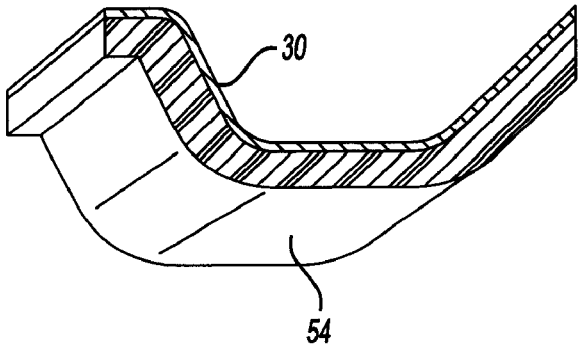
FIG. 9 is a cross-sectional view of the assembled partially formed panel and elastic membrane taken along the line 9-9 in FIG. 8.

Referring to FIGS. 8 and 9, a partially formed part 30 is shown with an elastic membrane 54. The elastic membrane 54 is preferably a polyurethane elastomer clamp that is used to hold the partially formed part 30 to support the part during the calibration operation. The high rate energy pulse is transmitted through the liquid to the elastic membrane 54 which in turn passes the pulse to the part 30.

Figure 10:
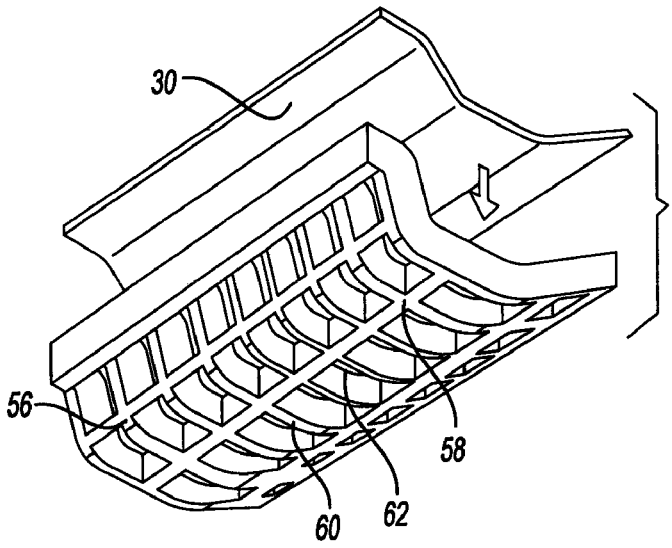
FIG. 10 is an exploded perspective view of a partially formed part and a reticulated clamp that may be used in the EHF forming tool as shown in FIG. 7.

Referring to FIG. 10, another alternative embodiment is shown in which a part 30 is supported during the EHF calibration process on a reticulated clamp 56. The reticulated clamp 56 has a plurality of longitudinal ribs 58 and transverse ribs 60 that define a plurality of openings 62. The openings 62 extend from the part 30 to the vessel so that the high rate energy pulse can be transferred from the liquid 28 through the openings 62 and directly to the part 30.

Figure 11:
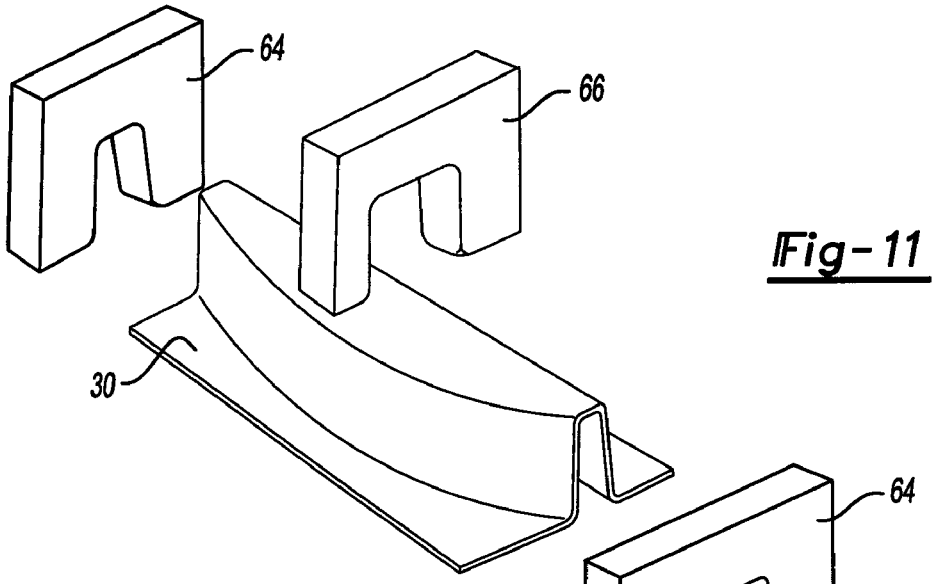
FIG. 11 is an exploded perspective view of a partially formed part and several clamps that may be used to hold the part during recalibration.
Figure 12:
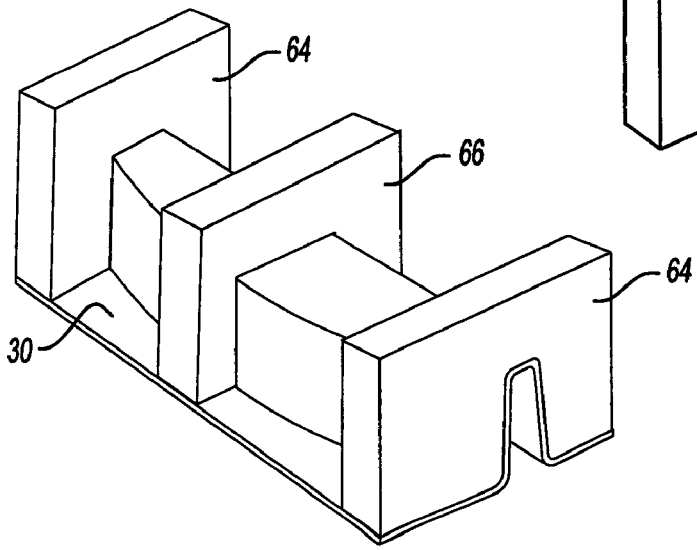
FIG. 12 is a perspective view of a partially formed part with a plurality of clamps secured to the part.

Referring to FIGS. 11 and 12, another alternative embodiment of the clamping structure used in the EHF calibration tool 36 is illustrated. A partially formed part 30 may be provided with end clamping plate 64 and a central clamping plate 66 that are configured to retain the part 30 in a desired shape when the clamps 64 and 66 are assembled over the part 30. The clamps 64 and 66 may be positioned at different locations on the part 30 in subsequent EHF calibration tool cycles so that portions of the part 30 that are shielded by the clamps 64 and 66 may be calibrated by placing similar clamps at other locations on the part 30.

While the best mode for carrying out the invention has been described in detail, those familiar with the art to which this invention relates will recognize various alternative designs and embodiments for practicing the invention as defined by the following claims.

What is claimed:

1. A method of calibrating a metal part that has been formed in a first direction to cause a first side of the part to protrude in the first direction, the method comprising:

loading the part onto a forming surface of a die in an electro-hydraulic forming tool that has at least one electrode that creates a high rate energy pulse;

clamping the part in the electro-hydraulic forming tool with the first side of the metal part facing the electrode; and applying the high rate energy pulse to the first surface to overcome a spring back effect in the part.

2. The method of claim 1 wherein the loading step further comprises loading the part into the electro-hydraulic forming tool having a chamber that is filled with a fluid, and wherein the applying step is performed by applying the high rate energy pulse that is in the form of at least one electro-hydraulic forming pulse that is transmitted to the first surface of the panel through the liquid.

3. The method of claim 1 wherein further comprising the pulsing step being performed on the first surface of the part to relieve stress in the part.

4. The method of claim 1 further comprising the pulsing step being performed on the first surface of the part and the part is stretched to eliminate spring-back in the part.

5. The method of claim 1 further comprising the part being formed in an electro-hydraulic forming tool before the loading step.

6. The method of claim 1 further comprising the clamping step being performed with a plurality of clamps that engage the first surface of the part and the high energy rate pulse is applied to exposed portions of the part not engaged by the clamps.

7. The method of claim 1 further comprising the part having a preliminary shape that after spring back is contoured with a gap being defined between the part and the forming surface of the die, wherein the gap allows the part to be stretched toward a final part shape.

8. A method of calibrating a partially formed metal part that has a first side that protrudes in a first direction, the method comprising:

clamping the first side of the part into engagement with an elastic membrane;

inserting the part and the elastic membrane into a tool that provides a high energy pulse and that includes a calibration die that has a forming surface, wherein the a first side of the part faces away from the forming surface; and pulsing the elastic membrane and the first side of the part with a high rate energy pulse to form the part against the forming surface to overcome a spring back effect in the part.

9. The method of claim 8 further comprising the elastic membrane being provided in conjunction with an electro-hydraulic forming tool that has a chamber that contains a liquid and a plurality of electrodes that are retained within the tool at spaced locations, wherein the electrodes receive a capacitive discharge that results in the high rate energy pulse being applied to the elastic membrane, and the first side of the part to calibrate the part to a desired shape.

10. The method of claim 8 further comprising the pulsing step being performed on the part and the part is stretched to eliminate spring-back in the part.

11. A an electro-hydraulic forming tool for forming a partially formed part to a final shape, the part having a first surface that protrudes in a first direction, the tool comprising:

a vessel that contains a liquid;

at least two electrodes disposed in the vessel and that are operatively connected to a capacitive discharge circuit;

a one sided die that is supported by the tool in the vessel;

a retaining ring that supports the partially formed part on the die with the first surface extending into the vessel; and at least one clamp that is assembled to the partially formed part and holds the part to the die, wherein a capacitive discharge from the discharge circuit causes the electrodes to provide a high energy rate pulse through the liquid to the first surface of the part to overcome a spring back effect in the part.

12. The tool of claim 11 wherein electrodes apply the high energy rate pulse to the part and wherein the part is stretched to eliminate spring-back in the part.

13. The tool of claim 11 wherein a plurality of clamps engage the part at spaced locations to define exposed portions of the part not engaged by the clamps.

14. The tool of claim 13 wherein the clamps are engage the part during the high energy rate pulse and wherein the clamps engage the previously exposed portions of the formed part with newly exposed portions being open to a second high energy rate pulse.

15. The method of claim 11 wherein the clamp is a reticulated clamp that includes ribs that define openings through the body of the clamp between the ribs.

16. A method of calibrating a partially formed metal part comprising:

loading the part onto a forming surface of a die;

clamping one side of the formed part onto the forming surface with a clamp so that portions of the formed part on a second side of the part that are not engaged by the clamp are exposed portions;

pulsing the exposed portions of the part with a high rate energy pulse to overcome a spring back effect in the part; and wherein the clamping step is performed in a first clamping step with a plurality of clamps that engage the part at spaced locations and the high energy rate pulse is applied in a first pulsing step to exposed portions of the part not engaged by the clamps, and wherein a second clamping step is performed with the clamps being repositioned on the part on the previously exposed portions of the formed part with newly exposed portions being open to a second pulsing step with a second high energy rate pulse.

17. A method of calibrating a partially formed metal part comprising:

loading the part onto a forming surface of a die;

clamping one side of the formed part onto the forming surface with a clamp so that portions of the formed part on a second side of the part that are not engaged by the clamp are exposed portions;

pulsing the exposed portions of the part with a high rate energy pulse to overcome a spring back effect in the part; and wherein the clamping step is performed with a reticulated clamp that includes ribs that define openings through the body of the clamp where the exposed portions of the formed part are open to the high energy rate pulse.

* * * * *